US009382032B2

(12) United States Patent
Kelly

(10) Patent No.: US 9,382,032 B2
(45) Date of Patent: Jul. 5, 2016

(54) STORAGE DEVICE AND STORAGE SYSTEM

(76) Inventor: Joseph Patrick Kelly, Dublin (IE)

( * ) Notice: Subject to any disclaimer, the term of this patent is extended or adjusted under 35 U.S.C. 154(b) by 484 days.

(21) Appl. No.: 13/349,037

(22) Filed: Jan. 12, 2012

(65) Prior Publication Data

US 2012/0211492 A1 Aug. 23, 2012

Related U.S. Application Data

(63) Continuation of application No. PCT/EP2010/060253, filed on Jul. 15, 2010.

(60) Provisional application No. 61/226,335, filed on Jul. 17, 2009.

(30) Foreign Application Priority Data

Jul. 15, 2009 (IE) ..... S2009/0539

(51) Int. Cl.
*B65D 5/42* (2006.01)
*B65D 85/18* (2006.01)
(Continued)

(52) U.S. Cl.
CPC ..... *B65D 5/302* (2013.01); *B65D 5/4295* (2013.01); *B65D 5/68* (2013.01); *B65D 11/1893* (2013.01); *B65D 85/187* (2013.01)

(58) Field of Classification Search
CPC ..... B65D 81/263; B65D 5/4295; B65D 11/1893; B65D 85/187; B65D 5/68
USPC ..... 220/4.33, 4.29, 4.28, 666, 676, 669, 220/4.31, 4.32, 6, 7, 4.22, 4.23; 206/600, 206/1.5, 577, 759, 757, 756
See application file for complete search history.

(56) References Cited

U.S. PATENT DOCUMENTS 1,407,688 A * 2/1922 Banton ..... 220/676
4,170,313 A * 10/1979 Caves et al. ..... 220/7
(Continued)

FOREIGN PATENT DOCUMENTS

EP 1666366 6/2006
WO 2006064527 6/2006
(Continued)

OTHER PUBLICATIONS

Kelly, Japanese patent application No. 2012-520046, Preliminary report of issuance of a first office action from Japanese foreign counsel dated May 9, 2014, 3 pages.
(Continued)

*Primary Examiner* — J. Gregory Pickett
*Assistant Examiner* — Allan Stevens
(74) *Attorney, Agent, or Firm* — Brian S. Steinberger; Law Offices of Brian S. Steinberger, P.A.

(57) ABSTRACT

Collapsible storage device and system having a container with a planar section and side wall pivotably joined to the base so that the container is movable between a collapsed configuration in which the container is substantially flat and an expanded configuration defining a top opening and a side opening to an interior of the container. The storage device further includes a cover frame. Locking members are provided for securing the frame to the sidewall to close the top opening of the container and to form a rigid structure. The locking members include a complimentary shaped locking tooth and slot. The storage device is further provided with a closable flap or door which provides access to the interior of the container through the side opening when the container is in the expanded configuration.

13 Claims, 20 Drawing Sheets

(51) Int. Cl.

| | |
|---|---|
| ***B65D 5/30*** | (2006.01) |
| ***B65D 5/68*** | (2006.01) |
| ***B65D 6/24*** | (2006.01) |

(56) References Cited

U.S. PATENT DOCUMENTS

| | | | | | |
|---|---|---|---|---|---|
| 4,848,618 | A | | 7/1989 | Yuan | |
| D325,278 | S | | 4/1992 | Van Der Vlies | |
| D353,714 | S | | 12/1994 | Stromberg | |
| D355,073 | S | | 2/1995 | Junaedi | |
| D381,513 | S | | 7/1997 | Brauner | |
| 5,671,857 | A | * | 9/1997 | Stromberg | 220/7 |
| 5,829,595 | A | * | 11/1998 | Brown et al. | 206/600 |
| 5,890,595 | A | * | 4/1999 | Credle, Jr. | 206/501 |
| D413,439 | S | | 9/1999 | Bell | |
| D442,779 | S | | 5/2001 | Koefelda | |
| 6,349,877 | B1 | | 2/2002 | Bradford | |
| D537,249 | S | | 2/2007 | Shapiro | |
| D553,858 | S | | 10/2007 | Sabanci | |
| D594,232 | S | | 6/2009 | Wyse | |
| 7,861,879 | B2 | | 1/2011 | Samprathi | |
| 2005/0224494 | A1 | * | 10/2005 | Heinrichs | 220/4.28 |
| 2006/0113303 | A1 | * | 6/2006 | Huruta | 220/23.4 |
| 2006/0226143 | A1 | * | 10/2006 | Elstone et al. | 220/6 |
| 2007/0210083 | A1 | | 9/2007 | Li | |

FOREIGN PATENT DOCUMENTS

| | | | |
|---|---|---|---|
| WO | WO 2006064527 | A1 * | 6/2006 |
| WO | 2011006976 | | 1/2011 |

OTHER PUBLICATIONS

Kelly, Japanese patent application No. 2012-520046, Japanese office action, 6 pages.

Kelly, Chinese patent application No. 2010800310900, Chinese office action, 2 pages.

Kelly, Chinese patent application No. 201080031090.0, letter from foreign counsel law office, 5 pages.

Kelly, Chinese patent application No. 201080031090.0, letter from foreign counsel law office, 10 pages.

* cited by examiner

STORAGE DEVICE AND STORAGE SYSTEM

CROSS REFERENCE TO RELATED APPLICATIONS

This invention claims the benefit of priority to Patent Cooperation Treaty Application PCT/EP2010/060253 filed Jul. 15, 2010, which claims the benefit of priority to U.S. Provisional Patent Application Ser. No. 61/226,335 filed Jul. 17, 2009, and Irish Patent Application No. S2009/0539 filed Jul. 15, 2009, and this invention claims the benefit of priority to U.S. Design patent application Ser. No. 29/352,819 filed Dec. 28, 2009, now allowed.

FIELD OF INVENTION

The present invention relates to a storage device and storage system, and more particularly, to a storage device that once erect can be joined with other adjacent storage devices to form a modular storage system.

BACKGROUND AND PRIOR ART

Currently there are many known storage devices which are suitable for storing different types of articles or products. For example, there are numerous devices for storing perishable items such as fruit or vegetables. Such storage devices include waxed or unwaxed cartons where the cartons are either in of a tray or two-piece format. Usually the cartons are configured so that they are shop ready to reduce unnecessary waste. However these cartons are non returnable and are discarded by the shop or end user.

There are also numerous storage devices for storing footwear, such as shoes, sandals, boots and the like. Storage devices suitable for storing footwear include for example, shoe racks, organizers, rolling plinths and so forth. However these devices are open to the surrounding environment, consequently the stored footwear is exposed to ambient dust particles and are prone to damage. For these reasons, it is preferable to store such items in sealed containers.

Examples of known sealed storage devices include cardboard and clear plastic boxes or containers. Such devices are also suitable for storing other items such as articles of clothing or bedding. Conventional design of such boxes or containers facilitates stacking so that the containers are able to be stacked one on top of the other. However, with such a stacked arrangement it is first necessary to remove the container from the stack in order to access the item contained within. Further problems regarding ventilation of footwear and space wastage when storing or transporting the containers also arise.

SUMMARY OF THE INVENTION

It is a therefore an object of the present invention to provide a storage container and closure which is suitable for storing different types of products and articles and goes at least some way toward overcoming the above problems and/or which will provide the public and/or industry with a useful alternative.

It is acknowledged that the term 'comprise' may, under varying jurisdictions be provided with either an exclusive or inclusive meaning. For the purpose of this specification, and unless otherwise noted explicitly, the term comprise shall have an inclusive meaning—i.e. that it may be taken to mean an inclusion of not only the listed components it directly references, but also other non-specified components. Accordingly, the term 'comprise' is to be attributed with as broader interpretation as possible within any given jurisdiction and this rationale should also be used when the terms 'comprised' and/or 'comprising' are used.

Further aspects of the present invention will become apparent form the ensuing description which is given by way of example only.

According to a first aspect of the invention, there is provided a storage device comprising:

a container having a planar section and a side wall pivotably joined to the planar section so that the container is movable between a collapsed configuration in which the container is substantially flat, and an expanded configuration defining an opening to an interior of the container, and a cover frame and locking means for securing the cover frame to the side wall so as to close the opening of the container, whereby the locking means comprises a locking portion formed on one of the cover frame and the side wall, and a locking indent formed on one of the other of the cover frame and the side wall, the locking portion adapted for secure engagement in the locking indent.

The present invention thus provides a collapsible storage device which is able to be expanded and locked to the cover frame to form a rigid structure. The use of a locking means comprising a locking portion and indent ensures that the sealing frame unit, which is a substantially rigid structure, may effectively clip to the container to form a rigid closed storage device. The construction of the storage device is such that the side wall can be warped or stressed when fitting the cover frame so that when secured the cover frame and side wall are of a sound rigid construction. In a preferred embodiment of the invention the locking portion and indent are of complimentary shape to facilitate secure engagement of the locking portion within the locking indent.

It should be understood that the position of the container and cover frame within the storage device are interchangeable. Accordingly, in one arrangement of the invention the container forms the base of the storage device and the cover frame the top or lid of the storage device. In an alternative arrangement the cover frame forms the base of the storage device and the container forms the lid of the storage device.

Reference in the following description will be made to the present invention being used to store footwear, although it will be understood that the storage device may also be used for storing other items as required or as desired, including but not limited to, items of apparel, such as hats, clothing, under garments, bedding and the like. Furthermore it will also be apparent that the present invention is suitable for use in the storage and transportation of various types of produce, including perishable food items such as fruits and vegetables. Accordingly, reference to the use of the present invention for storing footwear should not be seen as limiting.

In another embodiment of the invention, the cover frame comprises a downwardly projecting skirt, and one of the locking portion and the indent is on the skirt and the other of the locking portion and the indent is on the side wall of the container.

Preferably, the locking means comprises a plurality of locking portions formed on one of the cover frame and the side wall, and a plurality of locking indents formed in the other of the cover frame and the side wall, the locking portions are adapted for secure engagement in the locking indents. Optionally the locking means comprises four pairs of locking portions formed on one of the sealing frame unit and the side wall, and four pairs locking indents formed in the other of the cover frame and the side wall, each locking portion adapted for secure engagement in a complimentary locking indent.

In a further embodiment of the invention the cover frame further comprises an upwardly projecting collar. Conveniently the upwardly projecting collar is configured to enable a further storage device to seat within the collar portion such that the further storage device is securely retained by collar of the cover frame to facilitating secure stacking of one or more storage device on top of each other.

Optionally in a further embodiment of the invention the cover frame comprises both the downwardly projecting skirt and the upwardly projecting collar.

In a further embodiment of the invention, the side wall of the container is configured so that when the container is in an expanded configuration the side wall further defines a side opening to the interior of the container. This will allow a user to access the interior of the container without the need to remove the cover frame or to remove the storage device from amongst a collection of storage devices when it is part of a stacked configuration.

Preferably, the storage device comprises side closing means which provides access to the interior of the container through the side opening when the container is in the expanded configuration.

Conveniently in one embodiment of the invention the side closing means comprises a closable flap or door. Such a flap or door provides a means to access the contents of the container and thereby allows retrieval and placement of storage articles in the storage device without disturbing other storage devices when in a stacked configuration.

Optionally, in a further embodiment of the invention, the side closing means further comprises an opening which is covered by a tear away disposable portion. Conveniently the opening is sized and shaped to allow a user to access the contents held within the interior of the container. In this way a filled storage device can be transported securely without damaging or loosing the contents of the storage device. Furthermore a user receiving the filled storage device can easily retrieve the contents of the storage device by removing the tear away portion.

In a further embodiment of the invention, the side closing means comprises a tear away disposable portion.

In a further embodiment of the invention, the cover frame is provided with guide means which allow the side closing means to be inserted into the cover frame for closure of the side opening of the container.

In a further embodiment of the invention, the container is provided with side wall stabilising means. Preferably, in one embodiment of the invention the side wall stabilising means are provided as support legs on the side wall of the container. The support legs engage with the planar portion of the container when the container is in the expanded configuration thereby preventing the side wall from folding into the interior of the container. Ideally the side wall support legs do not engage with the planar portion of the container when the container is in the substantially flat collapsed configuration. In the preferred embodiment of the invention the side wall stabilising means are provided in opposing positions on the side wall of the container.

In one embodiment of the invention, the side wall stabilising means are provided such that they are adjacent the side opening to the interior of the container. This provides additional stability and strength to the side wall at the side opening thus ensuring that when the cover frame and side wall are secured together the storage device with a side opening is of sound rigid construction. In this way the storage device of the invention will support additional weight without the side wall deforming due to additional stress when the storage device is part of a stacked configuration.

Conveniently the dimensions of the side wall stabilising means is held in ratio with the measurements of the storage device as would be understood by a person skilled in the art. Accordingly the side wall stabilising means increases in size and number as the width and height of the storage device increases.

In a further embodiment of the invention the side wall of the container is provided with side wall connection means. Conveniently this facilitates the provision of a side wall comprising separate wall sections. In this way the separate wall section of the side wall can be secured together to form a single wall as desired. The side wall connection means enables adjacent sections of the side wall to separate when in the collapsed configuration and to rejoin forming a continuous side wall when in the expanded configuration.

In another embodiment of the invention, one or more of the base, side wall and the cover frame comprises an array of protrusions.

Preferably, each protrusion comprises at least one venting aperture. This will allow for air flow through the container to prevent the retention and build up of odours during storage. If stored after wearing the temperature differential between the footwear and the interior ambient of the storage device will cause a pressure differential and flow will occur venting any odours.

In a specific embodiment, each protrusion comprises five venting apertures.

Preferably, the location and orientation of the venting apertures allows the passage of air but prevents the direct fall of dust from entering the storage device.

In another embodiment of the invention, the venting apertures are arranged on an interior surface of the base and sidewall and face in an upward direction. This protects the ventilation system from downward fall of damp air and dust. The thermal-driven warmer cleaner air rises allowing the dehumidifying, antifungal, antibacterial and deodorising flow of air to protect and condition stored articles, such as shoes.

In a further embodiment of the invention, the storage device is provided with venting apertures on one or more of the protrusions and on the interior surface of the base or sidewall.

Preferably, the storage device is constructed from transparent material. The advantage of this is that the article held within the storage device is visible to a user.

In another embodiment of the invention, when in the collapsed configuration the base and sidewall are adapted to be contained within the cover frame. In this way when not in use the storage device of the invention can be folded for storage or to be returned to source for repackaging. It is also understood that each of the container and/or cover frame of the container could each be separately folded for storage or to be returned to source for repackaging.

In another embodiment of the invention, the cover frame comprises side connectors for securing the cover frame to a cover frame of an adjacent storage device.

Preferably, the connectors are tongue and groove type connectors.

In one embodiment of the invention, the base of the container comprises connection holes for receiving protrusions extending from a cover frame of another storage device to facilitate secure stacking.

In another embodiment of the invention, the base mounts ground engaging feet.

Preferably, the ground engaging feet are formed by protrusions in the base. Such a feature allows main surface of the base to be elevated from the floor and minimise surface contact and surface tension which allows smooth and easy movement on floor surfaces, such as wood, carpet, tiles and the like.

In an alternative embodiment, the base mounts ground engaging casters.

Preferably, the storage device is made from one or more of sheet material, corrugated material, extruded moulded plastics, vacuum, roto or blow moulded plastics, cardboard and hybrid materials.

Preferably, the storage device comprises a tray or drawer for inserting on the base of the storage device to form a type of aeration chamber. Optionally the tray or drawer is raised above the internal surface of the base to form a gap there between the base and the tray. In one embodiment the tray comprises holes to create an enhanced air chamber under the shoe or product that is stored in the storage device.

According to a further aspect of the invention, there is provided a storage system comprising a plurality of storage devices configured according to the first aspect.

Further objects and advantages of this invention will be apparent from the following detailed description of the presently preferred embodiments which are illustrated schematically in the accompanying drawings.

BRIEF DESCRIPTION OF THE FIGURES

The invention will be more clearly understood from the following description of some embodiments thereof, given by way of example only, with reference to the accompanying drawings, in which.

DESCRIPTION OF THE PREFERRED EMBODIMENTS

Figure 1B:
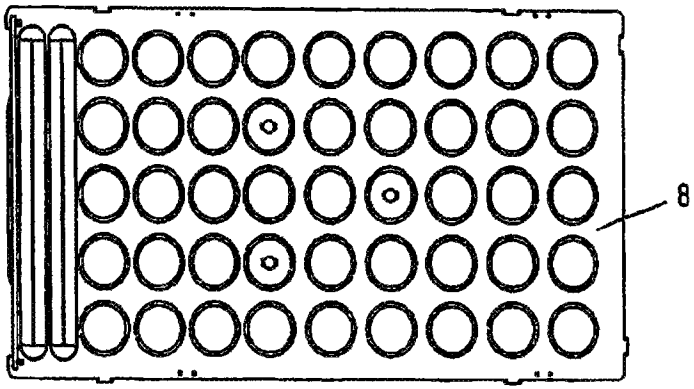
FIGS. 1*a*, 1*b*, 1*c* and 1*d* are perspective, top, side and end view respectively showing a storage device configured according to the present invention.
Figure 1D:
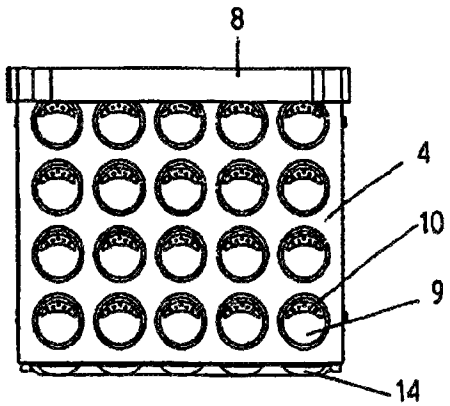
Figure 1A:
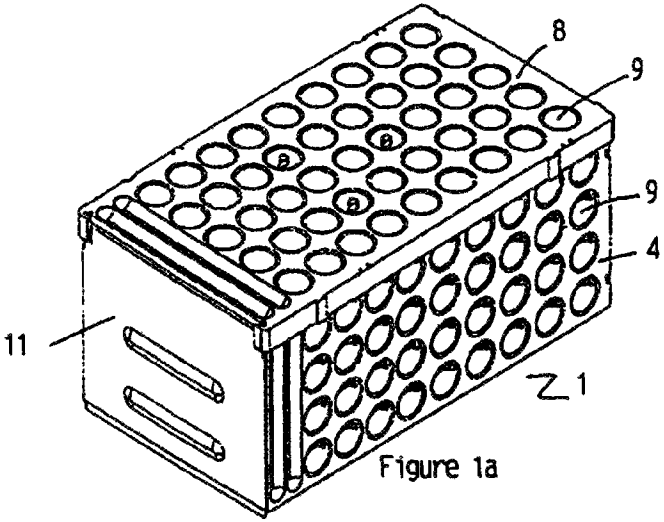
Figure 1C:
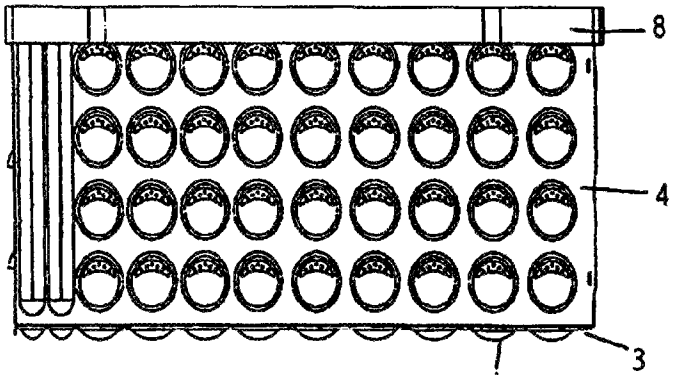
Figure 2:
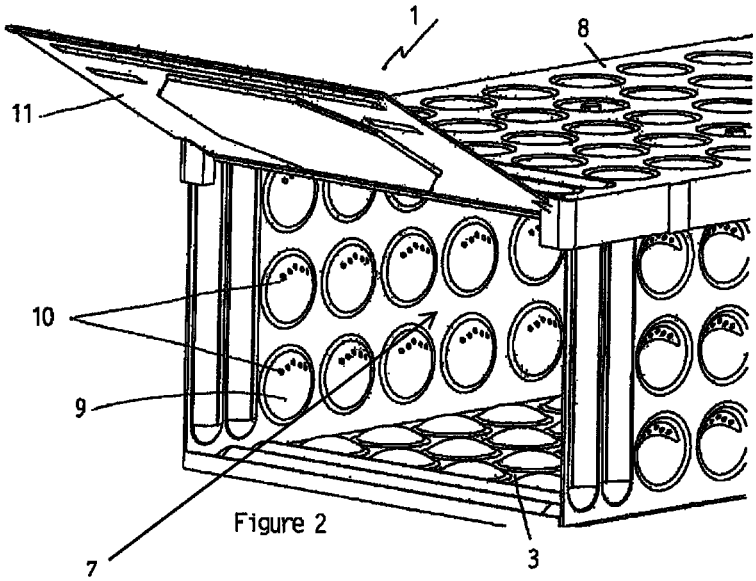
FIG. 2 is a perspective view showing the storage device of FIG. 1*a* in which a flap door is open.
Figure 3:
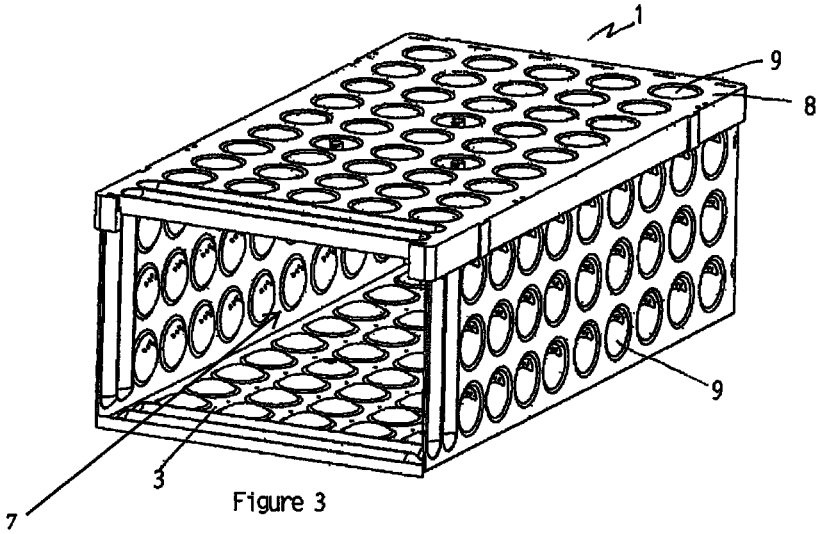
FIG. 3 is a perspective view showing the storage device of FIG. 1*a* without the flap door.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

This invention claims the benefit of priority to U.S. Design patent application Ser. No. 29/352,819 filed Dec. 28, 2009, now allowed, which is incorporated by reference.

Referring to the drawings, and initially to FIGS. 1 to 5*g*, there is shown a storage device formed as a container, indicated generally by the reference numeral 1, configured according to the invention. The container 1 may be made from sheet material, corrugated material, extruded moulded plastics, vacuum, roto or blow moulded plastics, cardboard and hybrid materials. A storage system comprising a plurality of the containers 1 stacked on top of each and connected in a side by side fashion is also envisaged in a further aspect of the present invention.

Figure 4A:
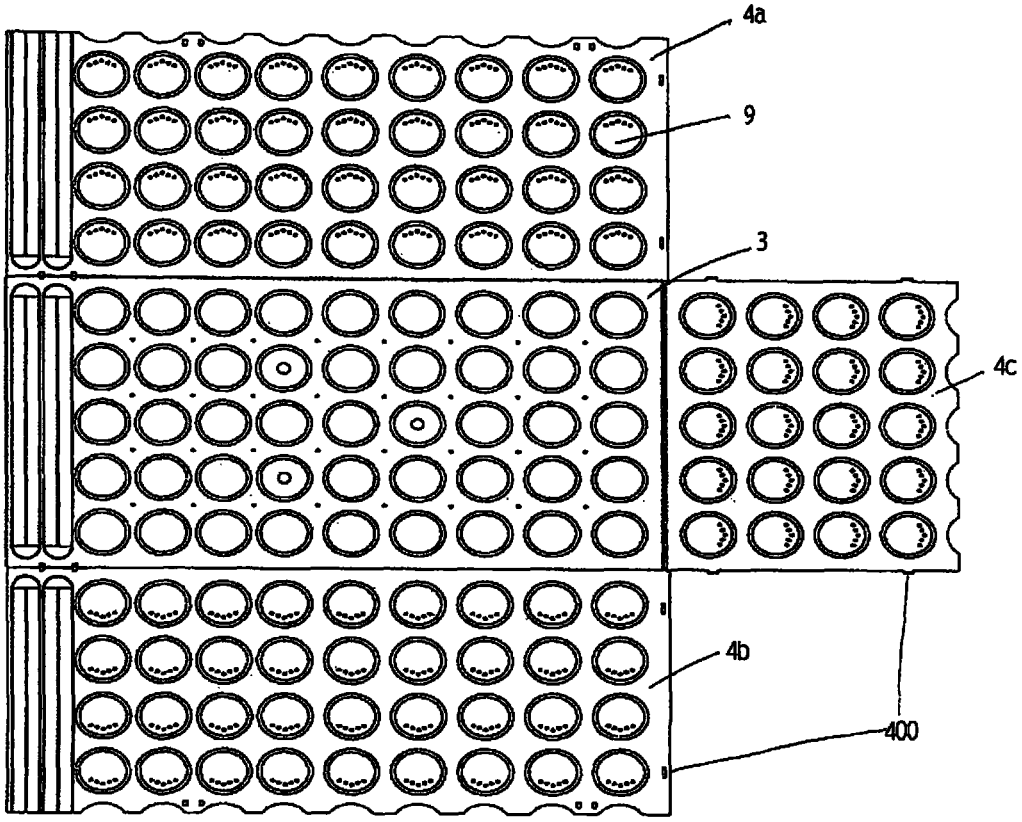
FIG. 4*a* is a top view of a base and side wall for the storage device of FIG. 1*a* in a collapsed configuration.
Figure 4B:
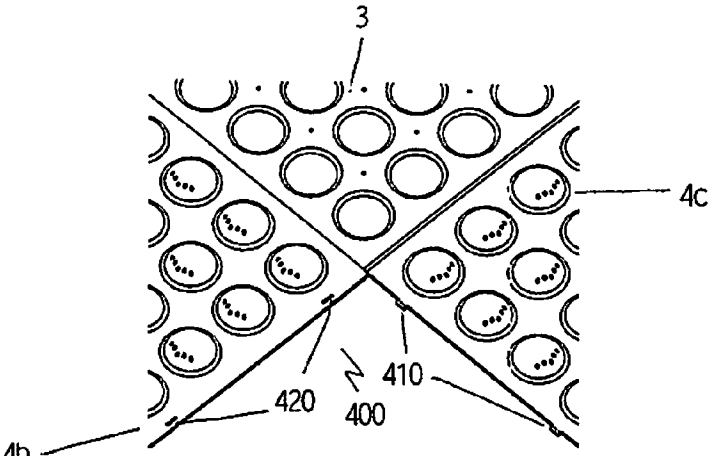
FIG. 4*b* is a magnified section view of the side wall connection means of FIG. 4*a;*

The container comprises a base or planar section 3 and a side wall 4. For the purposes of describing this embodiment of the invention, the terms base and planar section are used interchangeably. In the embodiment shown, the side wall 4 comprises separate wall sections 4*a*, 4*b* and 4*c*, each of which is pivotably joined to the base 3 so that the container 1 is movable between a collapsed configuration, as shown in FIG. 4*a*, in which the container 1 is substantially flat, and an expanded configuration, as shown in FIGS. 5*a* to 5*g*. In the expanded configuration there is a top opening, indicated generally by the reference numeral 5, and a front opening, indicated generally by the reference numeral 6, to the interior 7 of the container 1.

Additional internal support connections and clips are provided to lock the side walls 4*a*, 4*b* and 4*c* together with base 3 for added stability, strength and rigidity. Separate wall sections 4*a*, 4*b* and 4*c* are provided with side wall connection means 400. In the embodiment shown side wall connection means 400 comprise a tab 410 which is inserted into a matching opening 420 as shown specifically in FIGS. 4*b* and 5*a* to 5*c*. The opening 420 is sized and shaped to provide a resistance fit for tab 410.

The base 3 may optionally comprises ground engaging feet, casters or other means for enabling the container 1 to be easily moved along the ground. The ground engaging feet may be formed by protrusions 14 formed in the base 3. Such a feature ensures the base 3 is elevated from the floor whilst also minimises surface contact and tension which allows smooth and easy movement on floor surfaces, such as wood, carpet, tiles and the like.

In the instance shown, the base 3, side wall 4 and the cover frame 8 comprises an array or arrangement of protrusions 9. Each of the protrusions on the side wall 4 comprise a plurality of venting apertures 10 which face in and upward direction. This protects the ventilation system from downward fall of damp air and dust. The venting apertures 10 allow for air flow through the container to prevent the retention and build up of odours during storage of articles. The location and orientation of the venting apertures 10 allows the passage of air through the container 1 but prevents the direct fall of dust from entering the container. In the instance shown, further venting apertures are arranged on an interior surface of the base. The thermal-driven warmer cleaner air rises allowing the dehumidifying, antifungal, antibacterial and deodorising flow of air to protect and condition stored articles, such as shoes.

Figure 6A:
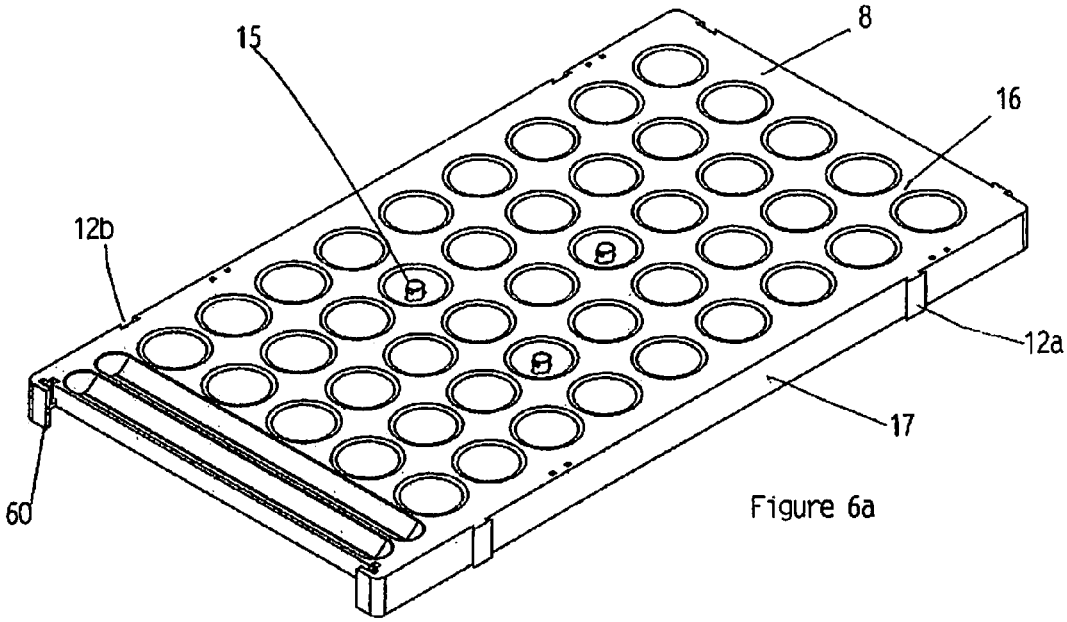
FIG. 6*a* is a perspective view of a cover frame for the storage device shown in FIG. 1.
Figure 6B:
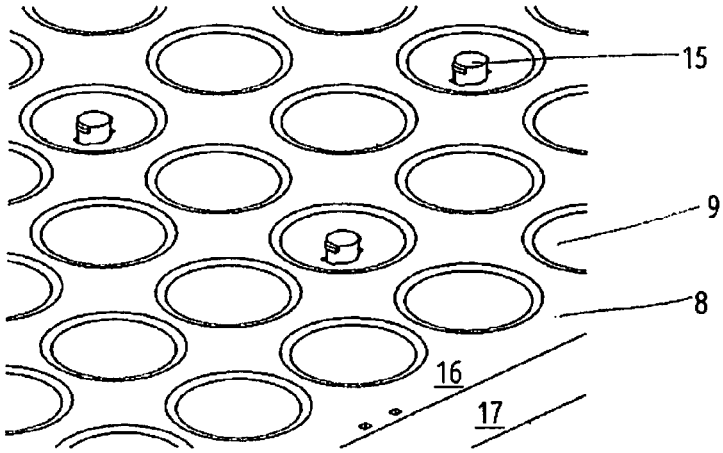
FIG. 6*b* is a magnified sectional view of the connections used for supporting a stacked configuration of storage devices in a preferred embodiment of the invention extending from the cover frame of FIG. 6*a;*

The base 3 of the container 1 comprises connection holes 15*a* for receiving protrusions 15 (as shown in FIG. 6*b*) from a cover frame 8 of another container to facilitate secure stacking.

Figure 4D:
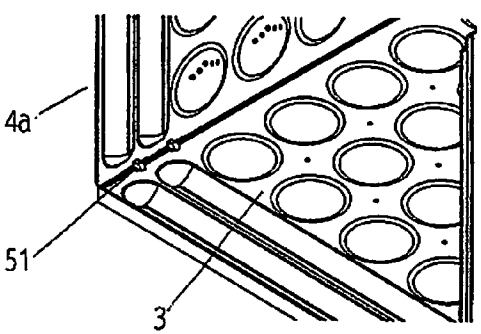
FIG. 4*d* is a magnified section view of the side wall stabilisation means of FIG. 4*c* in the expanded configuration.
Figure 4C:
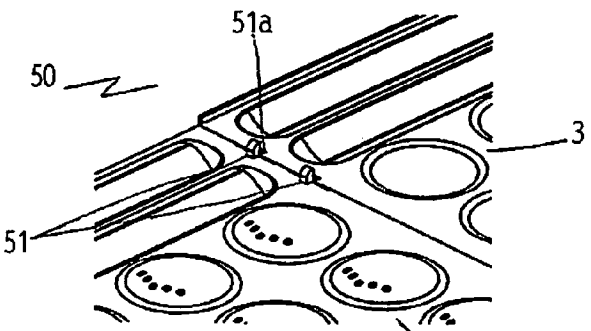
FIG. 4*c* is a magnified section view of the side wall stabilisation means of the storage device of FIG. 4*a* in a collapsed configuration.
Figure 5A:
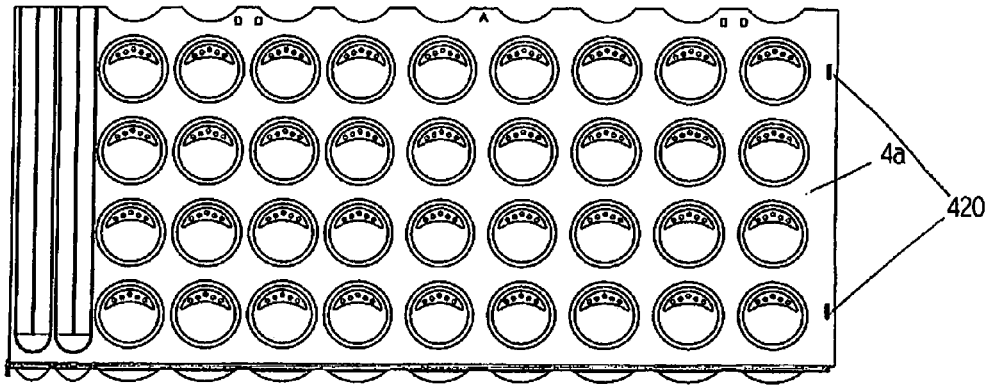
FIGS. 5*a*, 5*b* and 5*c* are side and end views respectively of the storage device of FIG. 4*a* in which the base and side wall are in an expanded configuration.
Figure 5B:
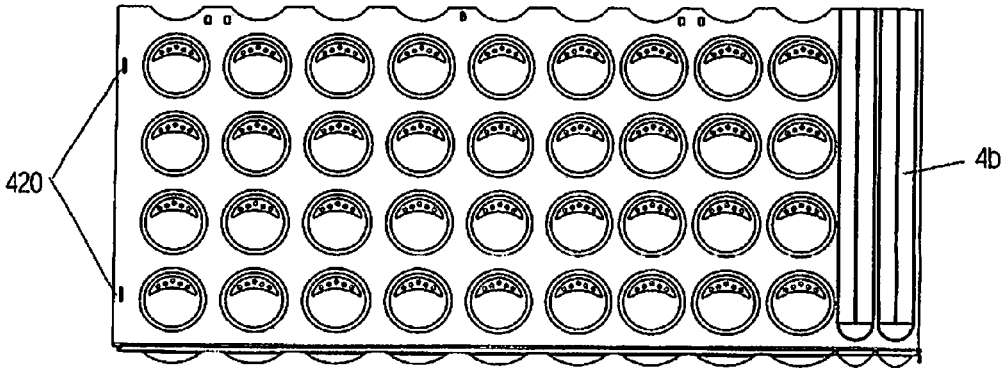
Figure 5C:
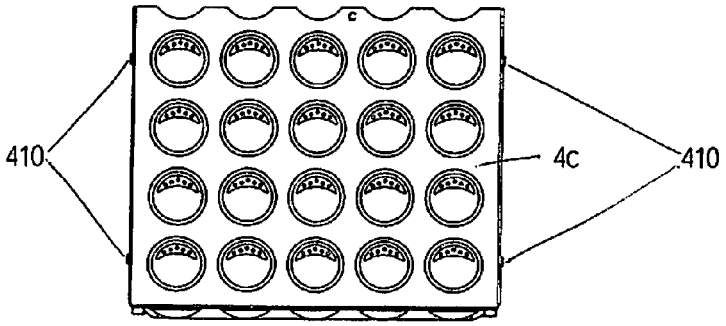
Figure 5D:
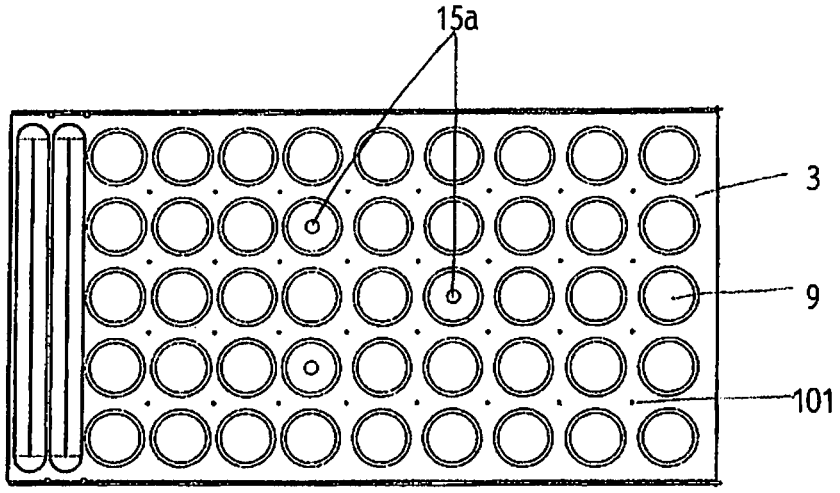
FIGS. 5*d*, 5*e* and 5*f* are bottom, top and front views respectively of the storage device of FIG. 4*a* in which the base and side wall are in an expanded configuration.
Figure 5E:
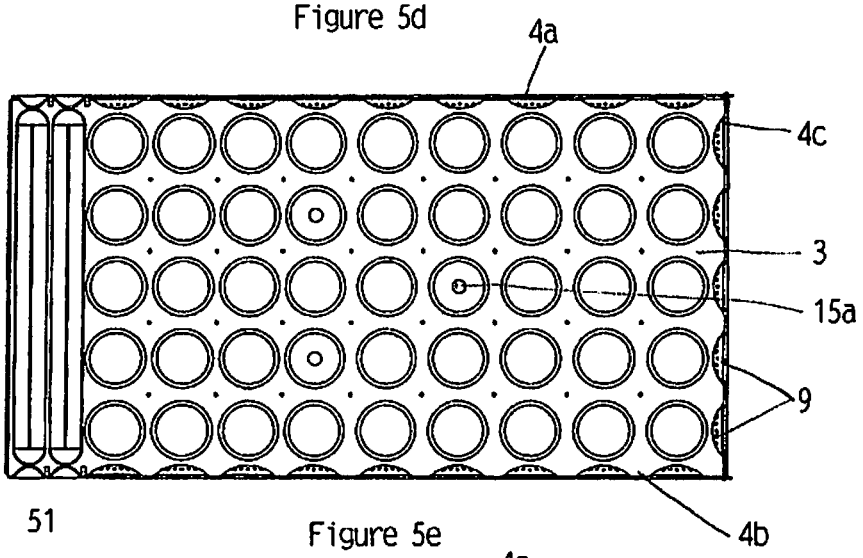
Figure 5F:
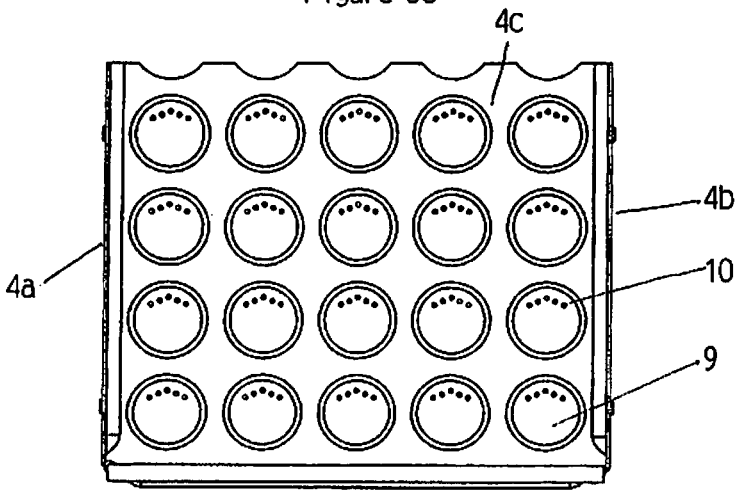
Figure 5G:
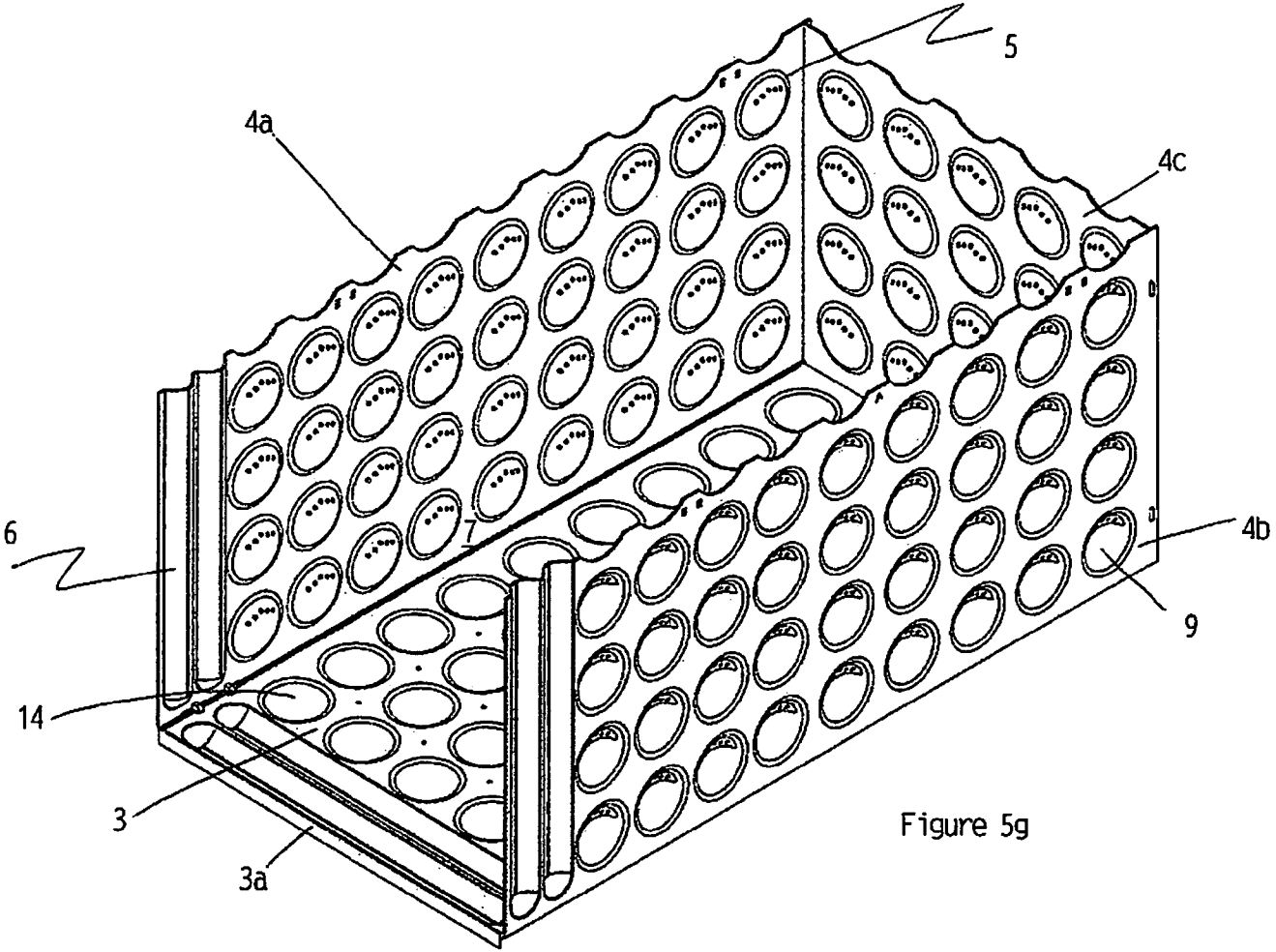
FIG. 5*g* is a perspective view of FIG. 4*a* in which the base and side wall are in an expanded configuration.

Referring specifically to FIGS. 4*c* and 4*d*, the side wall stabilizing means 50 comprising support legs 51 are shown. The support legs 51 are attached to the side wall 4 such that they project perpendicularly from the plane of the side wall 4. Accordingly when the side wall 4 moves from the collapsed substantially flat configuration into the expanded configuration the base 51*a* of the support legs 51 abuts the planar section or base 3 of the container 1 thereby preventing the side wall 4 from folding into the interior 7 of the container 1.

Figure 7:
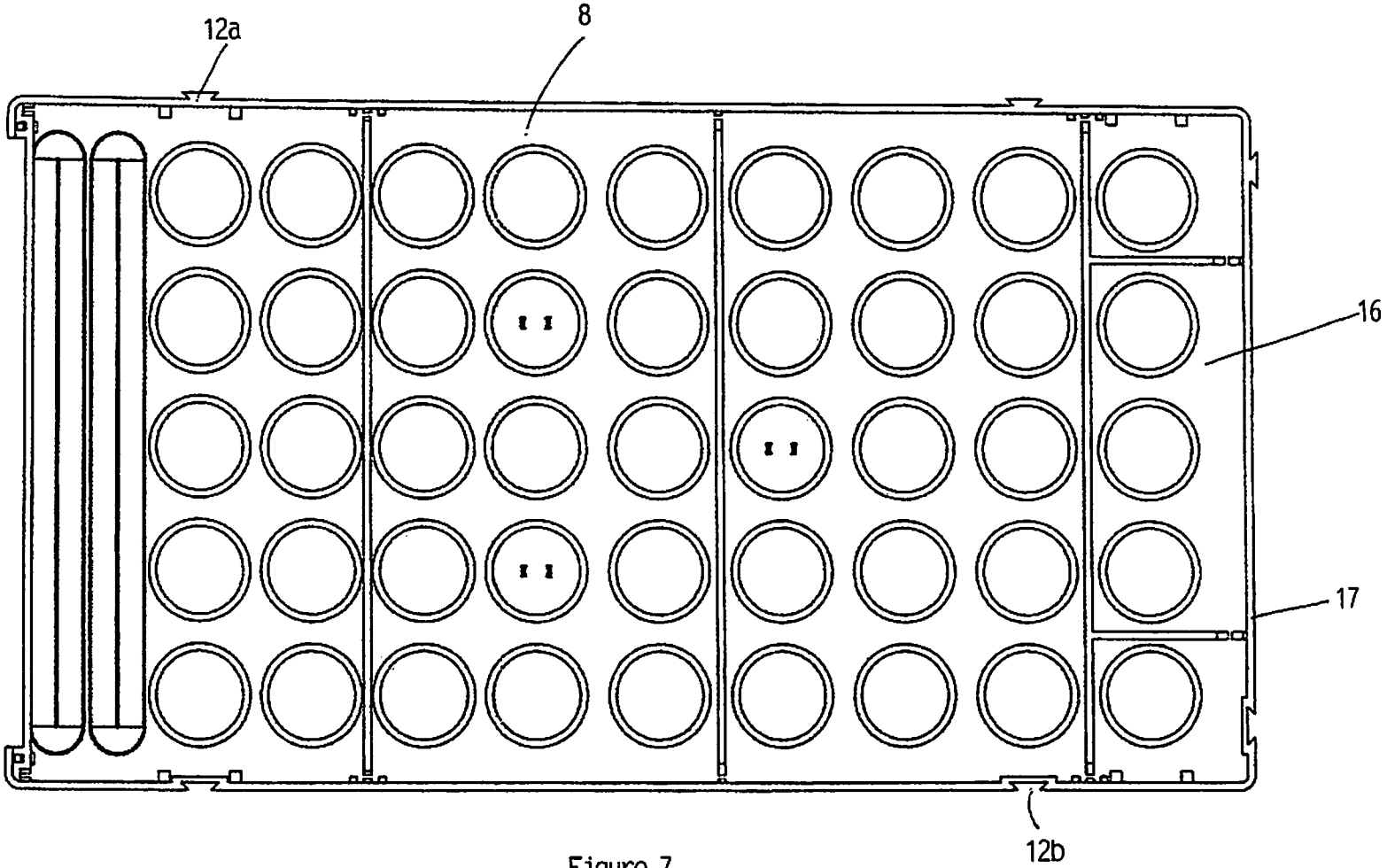
FIG. 7 is an underside view showing the cover frame of FIG. 6*a;*
Figure 8A:
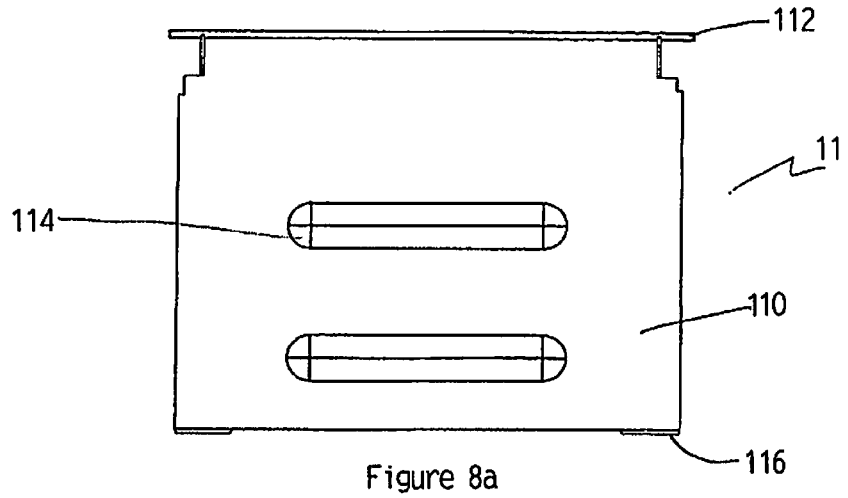
FIGS. 8*a* and 8*b* are a front view and side view respectively showing the flap door.
Figure 8B:
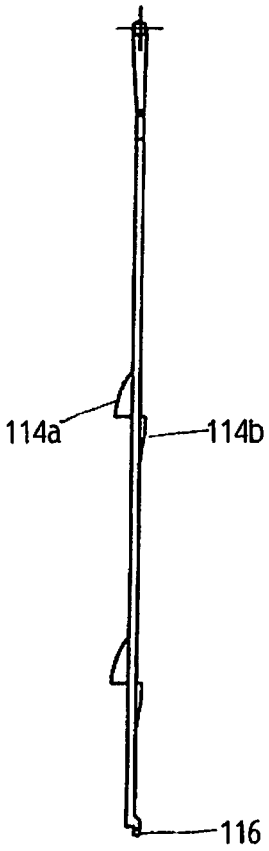
Figure 8C:
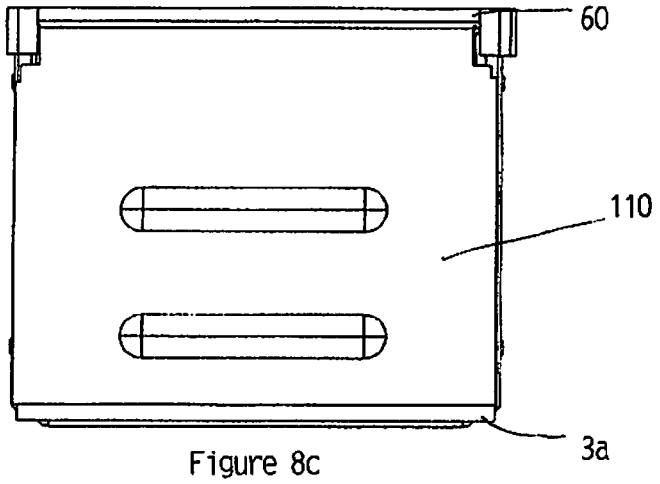
FIG. 8*c* is a front view of the flap door of FIGS. 8*a* and 8*b* held in position by the cover frame of FIG. 1.
Figure 8D:
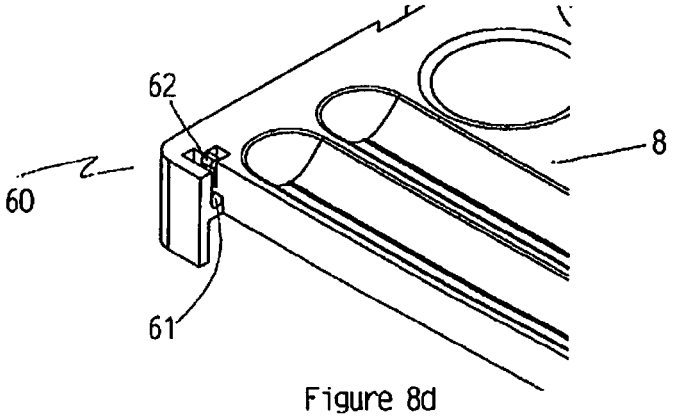
FIG. 8*d* is a magnified perspective sectional view of the guide means of the cover frame for supporting the flap door of FIGS. 8*a* and 8*b;*

The storage device also comprises a removable cover frame 8, shown in FIGS. 6*a*, 6*b* and 7, for closing the top opening 5. The cover frame 8 is a substantially rigid structure which is securable to the sidewall 4 to form a rigid enclosed box. The cover frame comprises a top wall 16 and a downwardly projecting skirt 17.

When in the collapsed configuration, the base 3 and sidewall 4 are adapted to be contained within the cover frame 8. The cover frame 8 is thus designed and constructed to hold the side wall 4 rigidly when erected. It is also designed to hold and stack one container 1 on top of another. The cover frame 8 may also have a duel purpose as a frame to hold the sides rigidly and also have a detachable top/cover frame built within it. Guide means 60 are provided on top of the cover frame 8 which may be used to drop a clear envelope to hold photos or information on the product in the container 1.

Figure 9:
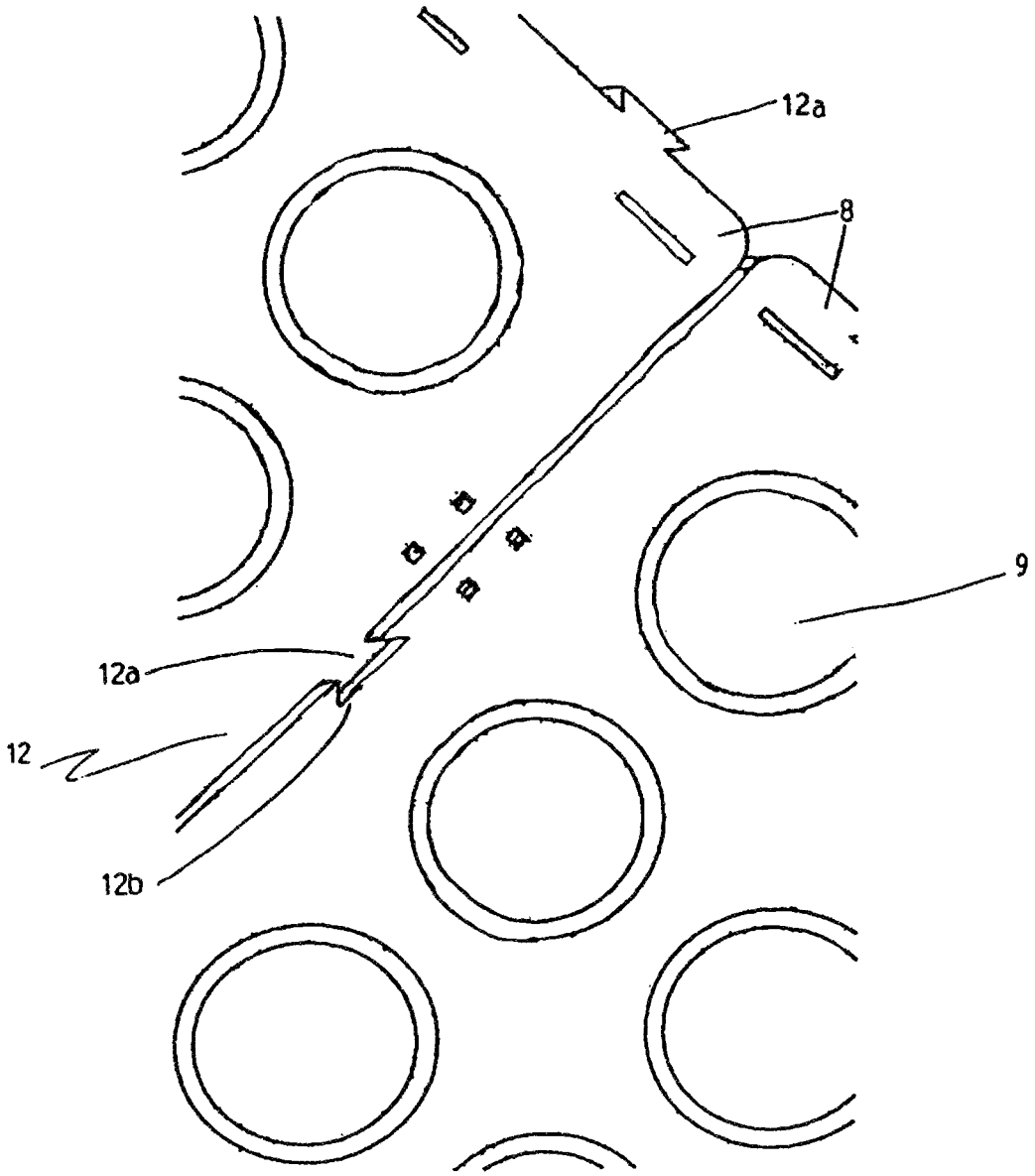
FIG. 9 is a perspective view of a pair of interconnected sealing frame units of adjacent storage devices.

The cover frame 8 comprises side connectors, indicated generally by the reference numeral 12, for securing the cover frame of one storage device to a cover frame of an adjacent storage device (as shown in FIG. 9). In the instance shown, the connectors 12 are tongue and groove type connectors so that the tongue 12*a* engages in a complimentary indent or groove 12*b* in a cover frame 8 of an adjacent storage device 1 forming a storage system.

The container 1 also comprises a closable flap or door 11 which provides access to the interior 7 of the container 1 through the front opening 6 when the container is in the expanded configuration. Such a configuration allows retrieval and placement of storage articles in the storage device without disturbing other storage devices when in a stacked configuration.

Referring now to FIGS. 8*a* to 8*d*, there is shown side closing means formed as a flap or door, indicated generally by the reference numeral 11. The door 11 comprises a predominantly planar door portion 110 projecting from a cylindrical portion or bar 112. The planar door portion 110 is sized and shaped such that it can be slotted into guide means 60 of the cover frame 8. Guide means 60 comprises a pair of spaced apart hooks 61 and corresponding stop means 62. The cylindrical portion or bar 112 is placed into hooks 61. Stop means 62 prevent the cylindrical portion or bar 112 from moving out of the hooks 61, however sufficient play is provided within the guide means 60 to allow the bar 112 to move or rotate freely about the longitudinal cylindrical axis.

Door 11 is further provided with a handle 114 and latching means 116. In the embodiment shown, handle 114 is formed in two sections 114*a* and 114*b* which project perpendicularly in opposite directions from planar door portion 110. There is an opening between the first and second sections 114*a* and 114*b*, in this way a sufficient gap is provided to allow air to circulate and to enable a user to insert their fingers to move or manipulate the door 11. The base 3 is provided with a lip 3*a*. Latching means 116 seats securely behind lip 3*a* and cannot be moved from this position without the application of an external force. Application of an external force lifts door 11 slightly which enables the latching means 116 to overcome lip 3*a* thus freeing door 11 is allowing it freely rotate about the cylindrical bar 112.

Figure 10:
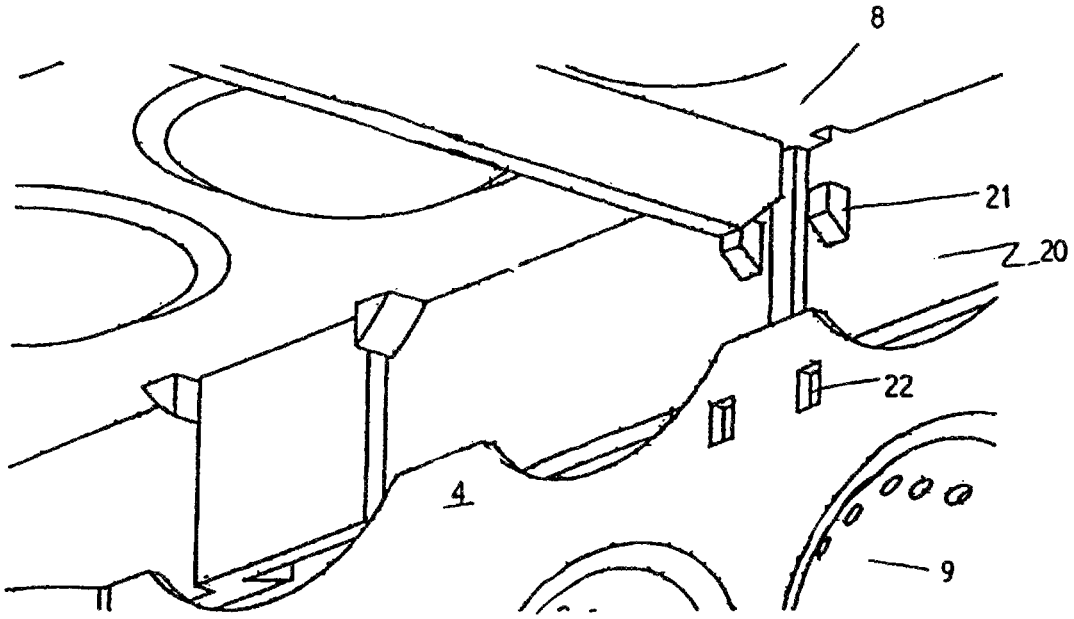
FIGS. 10 and 11 are perspectives view of the storage device of FIG. 1 showing a locking means of the present invention.
Figure 11:
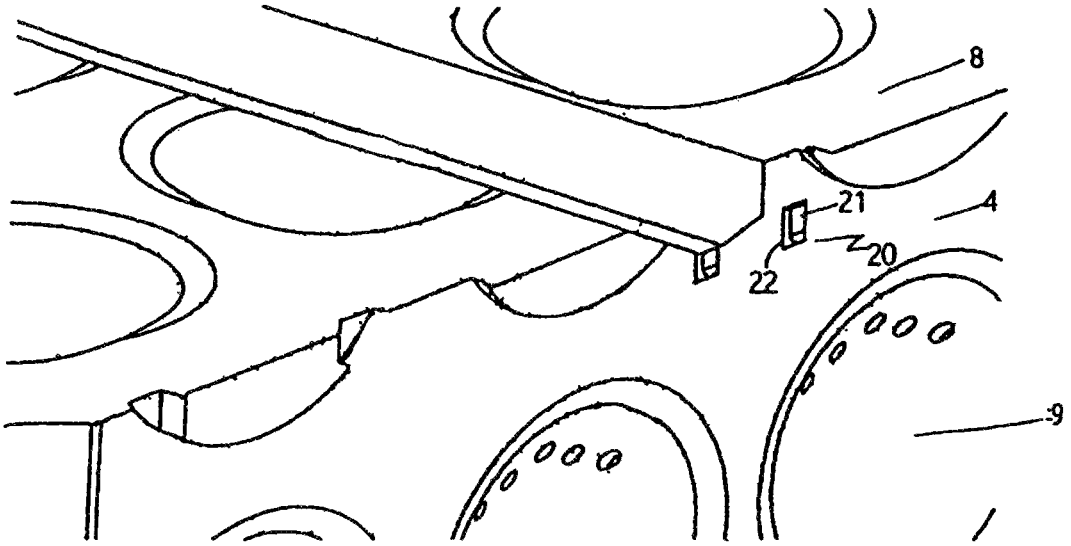

As shown in FIGS. 10 and 11 locking means, indicated generally by the reference numeral 20, is provided for securing the cover frame 8 to the sidewall 4 so as to close the top opening of the container 1. The locking means 20 comprises locking teeth 21 which in the instance shown are provided on the cover frame 8, and complimentary locking indents 22 formed in the sidewall 4. The locking teeth 21 are thus adapted for secure engagement in the locking indents 22. The use of such a locking means ensures that the cover frame may effectively clip to the container 1 to form a rigid storage device. The construction of the storage device is such that the side wall can be warped or stressed when fitting the cover frame using the locking means 20 so that when secured the cover frame and side wall are of a sound rigid construction.

The container 1 is preferably constructed from transparent material, although it will be understood that the container may be made of opaque, or any type of material as required or as desired. The container 1 may be used to store a variety of products, including, but not limited to footwear.

The present invention thus provides a modular storage solution built up from number of containers 1 in which each container 1 may be connected to the other to form a network of pigeon holes. Each container 1 is collapsible so that it can be folded to create a compact unit for transporting. Each container 1 can be accessed through the flap front door 11 for ease of loading and unloading. The protrusions/undulations 9 in the side walls 4 and planar section 3 contain a system of holes 10 that facilitates the flow of air. This flow of air is designed to prevent the retention and build up of odours when stored. The location and orientation of the holes 10 allows the passage of air but prevents the direct fall of dust from entering the container 1. The design of the container 1 can be in two or three parts comprising cover frame 8 which clips to the planar section 3 and side walls 4 to form a rigid enclosed box. The front flap or door 11 can be a separate component that clips to the cover frame 8, planar section 3 and or side walls 4 making a three piece construction.

The construction of the cover frame 8 is such that the planar section 3 and side walls 4 can be warped by the action of fitting causing stresses in the sides that make the construction more rigid. The container 1 is also insect resistant. The venting structures 10 are arranged in the protrusions 9 so that the venting surfaces are predominantly on the up sloped surface regions. The unique landscape of the half-moon and other venting positions ensure that these vents are on the inside of the container and face in an upward direction. This protects the ventilation system from downward fall of damp air and dust. The thermal-driven warmer cleaner air rises allowing the dehumidifying, antifungal, antibacterial and deodorising flow of air to protect and condition the shoes. The cover frame 8 can also have a top opening feature if required. The container 1 can be constructed so that it comprises material having an ultraviolet tint for the protection of product. The cover frame 8 is designed to create sideways forces that keep sides stiff and erect. The cover frame 8 will have catch points inside the rim to hold box above or below if used in reverse.

A useful function of the present invention is thus that it allows visible identification of the products inside. The container 1 can be nested, stacked or folded. The use of transparent plastic and the ability to retrieve and store shoes and other products without destacking the boxes is also advantageous. The container will be available in a number of sizes to fit all types and sizes of shoe wear or other stored articles.

Figure 12A:
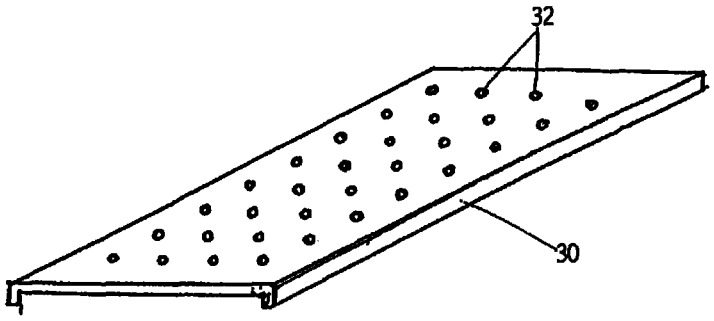
FIGS. 12*a* and 12*b* are perspective views of an aeration chamber suitable for use with the storage device of FIG. 1.
Figure 12B:
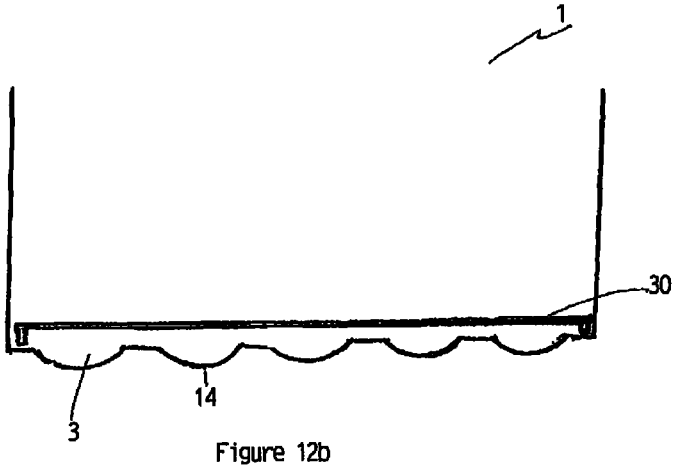

With reference to FIGS. 12*a* and 12*b*, there is shown a tray or drawer 30 for inserting on the base 3 of the storage device 1 to form a type of aeration chamber. In the instance shown, the tray 30 is raised above the internal surface of the base 3 to form a gap therebetween. The tray 30 comprises holes 32, which may be optionally clustered, and be located above the ground engaging protrusions 14 in the base 3. This feature may also be used independently of the storage device 1. Use of the tray insert 30 creates an enhanced air chamber under the shoe or product that is stored in the storage device 1. The extra natural air flow created by this chamber allows for the dissipation of odours, greater dehumidifying, anti-fungal/bacterial and drying properties for stored products. It allows the introduction of substances for air treatment into the chamber. These substances are isolated or physically separated from the stored product. Substances including pot pouri, perfume, airfreshner, other fragrance products, anti fungal, antibacterial, insect repellent, dehumidifying or any other product care substances can be placed in the under the tray 30 as required.

Figure 13A:
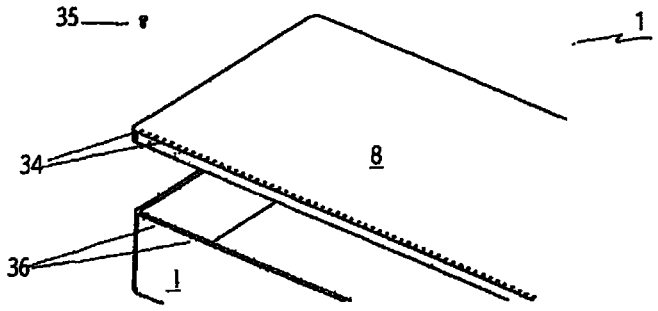
FIGS. 13*a*, 13*b* and 13*c* are perspective views showing alternative means of securing the cover frame to the side wall of the storage device.
Figure 13B:
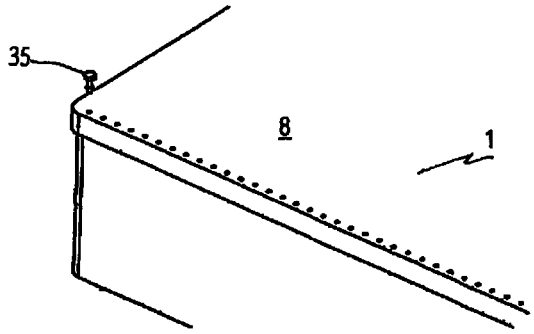
Figure 13C:
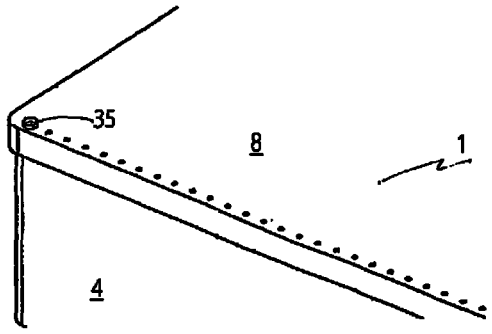
Figure 14:
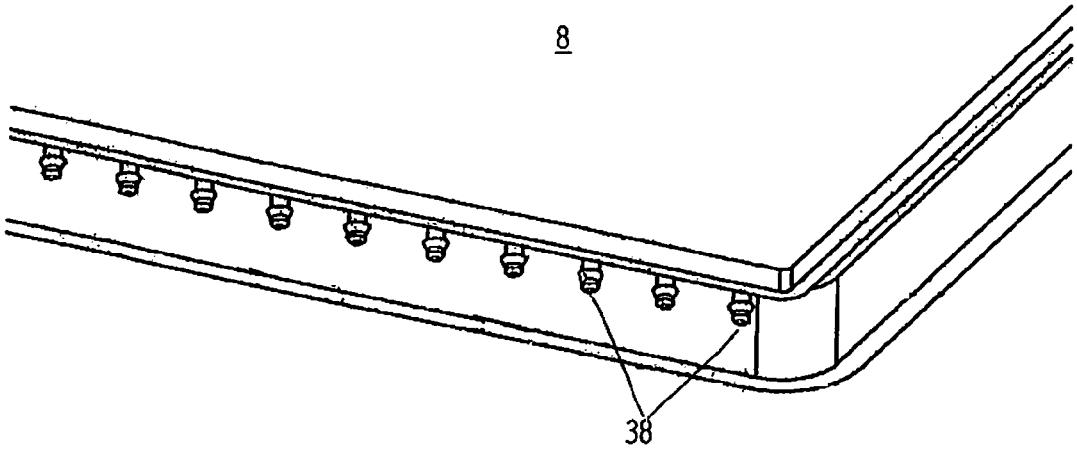
FIG. 14 is a perspective view showing moulded posts 38 provided in the cover frame or side walls of the storage device.
Figure 15:
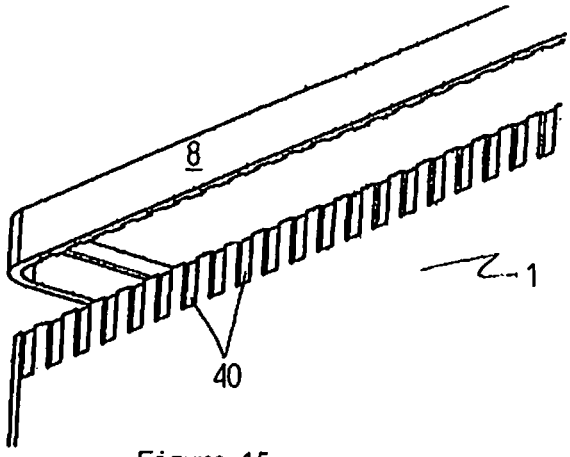
FIG. 15 shows a plurality of offset channels 40 in the cover frame 8 of the storage device.
Figure 16A:
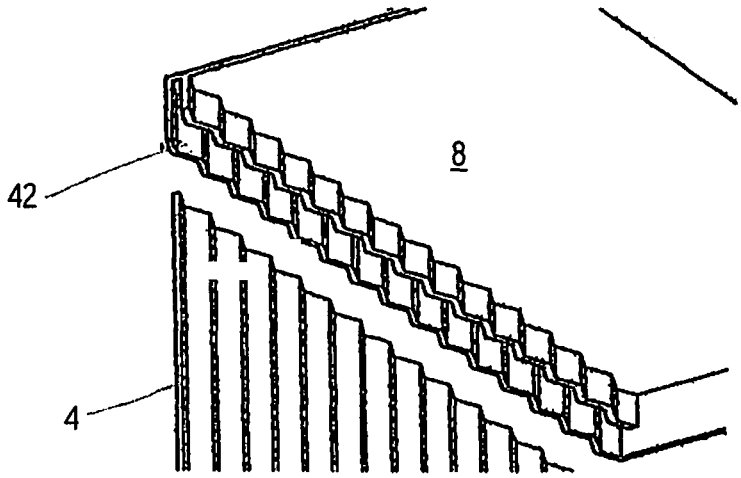
FIGS. 16*a* and 16*b* are perspective views showing a wave or undulating link between the cover frame and side walls of the storage device.
Figure 16B:
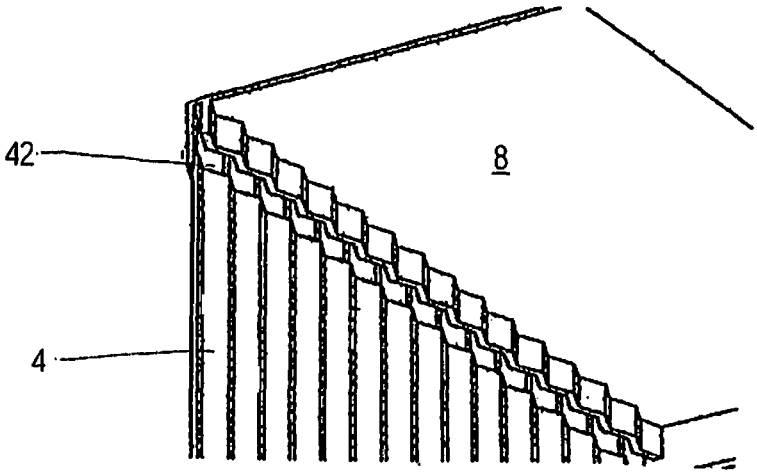

With reference to FIGS. 13*a* to 13*c*, the cover frame 8 and/or base 3 may have holes 34 in it to allow the introduction of fixings 35, including plastics, screws, nails and the like to be inserted through the cover frame 8 and into corresponding receiving holes 36 locating in sides walls 4 of the storage device 1. Such a feature will provide added rigidity to the side walls 4. As shown in FIG. 15, molded posts 38 may also project from the cover frame 8, the base 3 or side wall 4 to provide a male/female catch point or linking of the sealing frame unit/base and side wall. This feature is particularly useful if using corrugated plastic or cardboard sides. Further rigidity may also be provided by a plurality of offset channels 40 in the cover frame 8, as shown in FIG. 15. Still further rigidity may be provided using a wave or undulating link 42 between the cover frame 8 and sides 4, as shown in FIGS. 16*a* and 16*b*.

Figure 17:
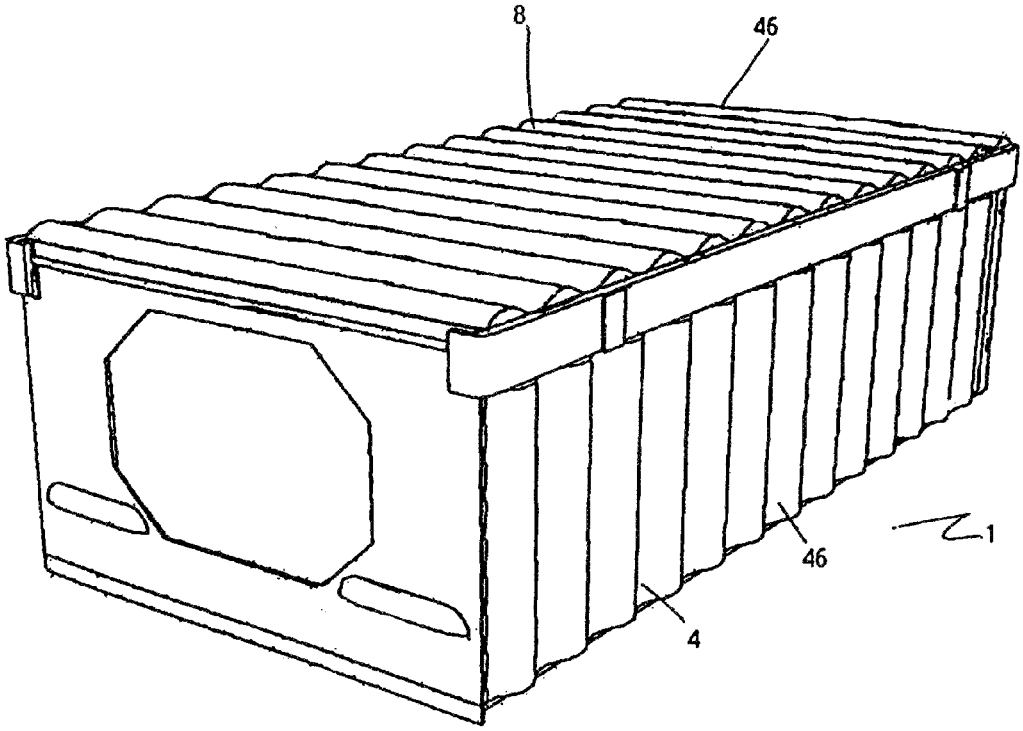
FIG. 17 is a perspective view of a storage device having a side wall and cover frame with undulating surfaces.

In an alternative embodiment, and as shown in FIG. 17, the side walls 4 and cover frame 8 may comprise undulations 46 to thereby impart a corrugated look to the storage device 1.

Figure 18:
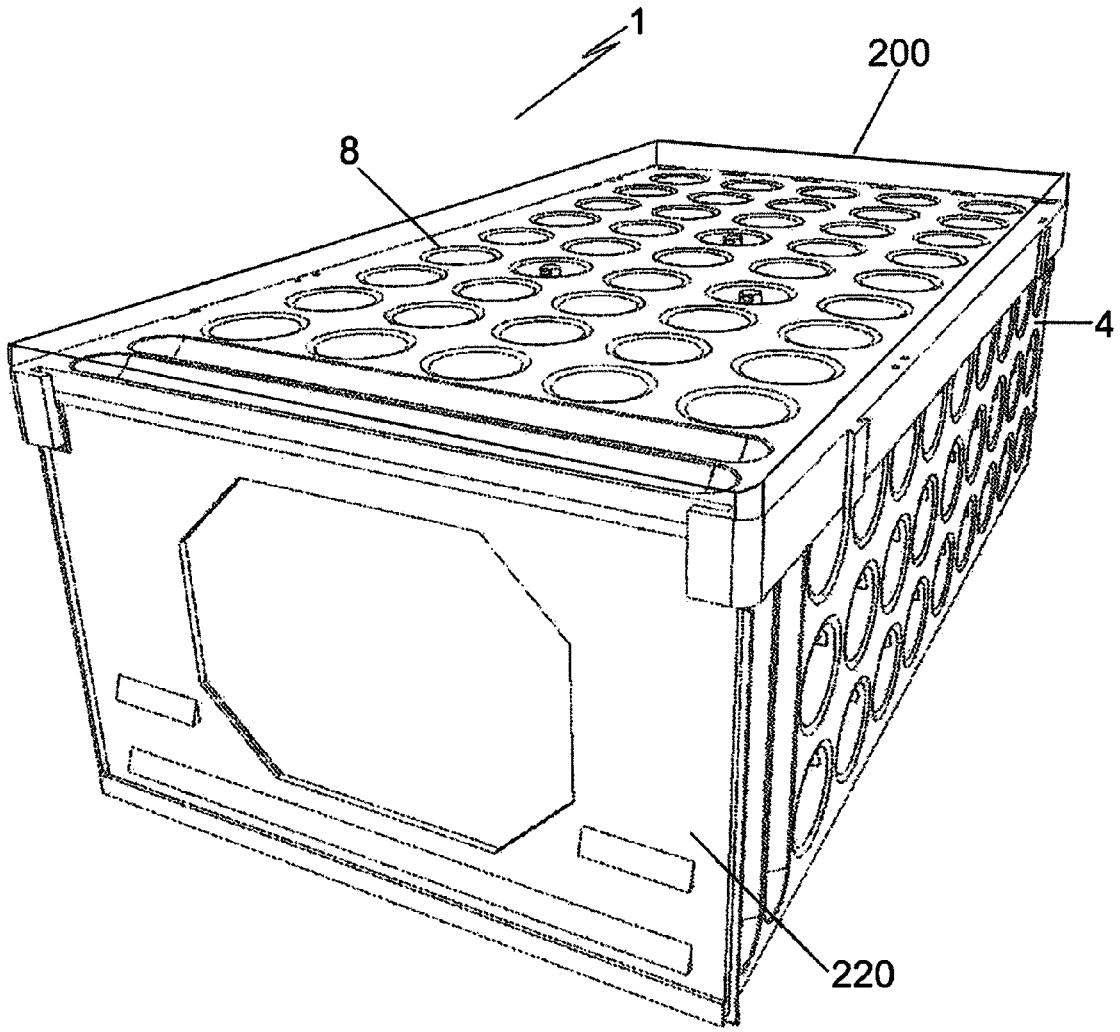
FIG. 18 is a perspective view of the storage device closed by a tear away portion and showing a cover frame including an upwardly projecting collar.

FIG. 18 shows an upward projecting collar 200 of the cover frame 8. Also shown in FIG. 18 is an embodiment in which the side closing means 11 of the storage device 1 is provided by a tear away disposable portion 220.

Figure 19:
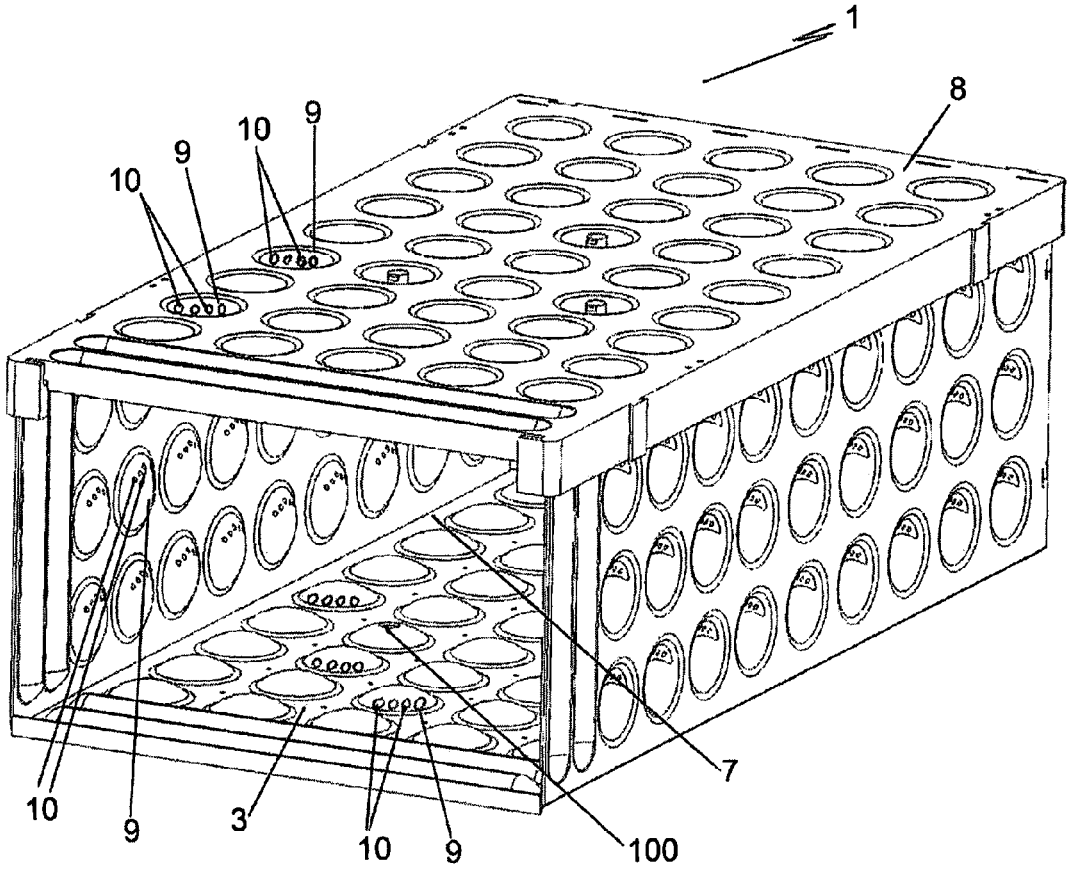
FIG. 19 is a perspective view of the storage device without a tear away portion and showing an array of protrusions and venting apertures.
Figure 20:
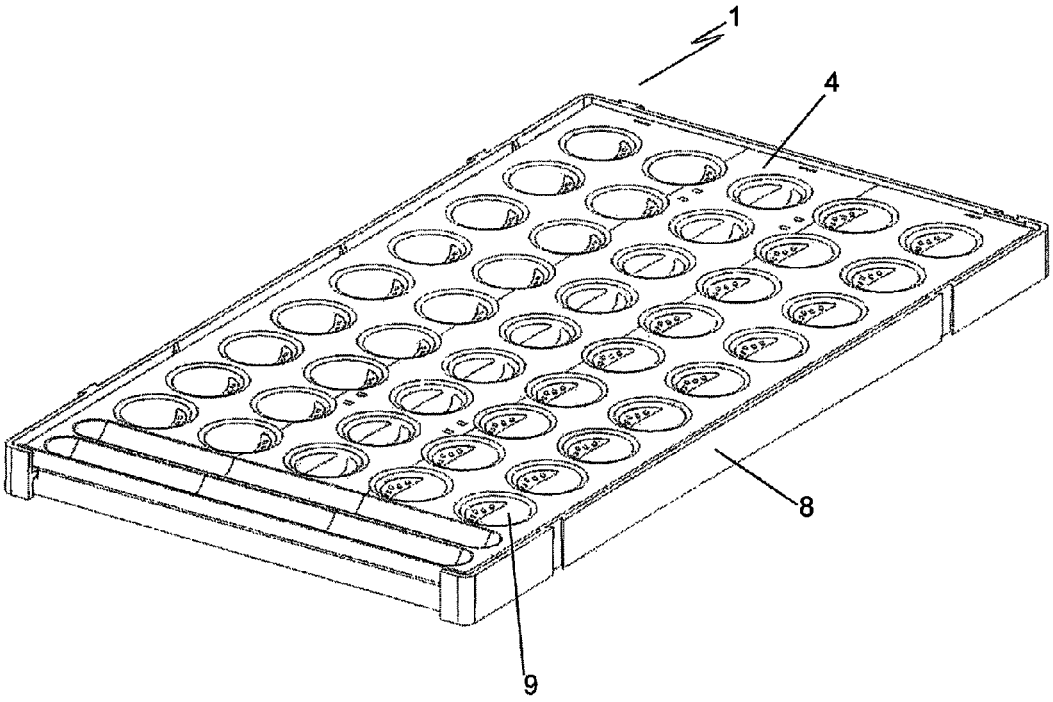
FIG. 20 is a collapsed configuration of the storage device.

FIG. 19 shows an array of protrusions 10 provided on the planar section 3 and cover frame 8 of the storage device 1. The protrusions 10 including venting apertures 9 arranged to allow the passage of air and prevent the direct fall of dust from entering the storage device 1. FIG. 19 also shows the interior 7 of the storage device (container) 1, and further venting aperature 100.

FIG. 200 shows a collapsed configuration for the storage device 1 in which the planar section and side wall are adapted to be contained within the cover frame 8.

It will of course be understood that the invention is not limited to the specific details described herein, which are given by way of example only, and that various modifications and alterations are possible within the scope of the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A storage device comprising:

a container having a planar section and a side wall pivotably joined to the planar section so that the container is movable between a collapsed configuration in which the container is substantially flat, and an expanded configuration defining an opening to an interior of the container;

a cover frame;

a locking member for securing the cover frame to the side wall so as to close the opening of the container, whereby the locking member comprises a locking portion formed on one of the cover frame and the side wall, and a locking indent formed on one of the other of the cover frame and the side wall, the locking portion adapted for secure engagement in the locking indent, wherein the side wall further defines a side opening to the interior of the container when the container is in the expanded configuration and the cover frame is secured to the side wall, and the container further comprises a side wall stabilizing portion comprising support legs that project perpendicularly from an interior facing surface of the side wall of the container to thereby engage with and abut against the planar section of the container and extend into the interior of the container adjacent to the side opening when the container is in the expanded configuration preventing the side wall from folding into the interior of the container, wherein one or more of the planar section, side wall, or the cover frame comprises an array of protrusions, wherein one or more protrusions provided on the side wall includes at least two venting apertures.

2. The storage device as claimed in claim 1, wherein the cover frame further comprises:

a downwardly projecting skirt, and one of the locking portion and the locking indent is on the skirt and the other of the locking portion and the locking indent is on the side wall of the container.

3. The storage device as claimed in claim 1, wherein the storage device further comprises a side closing means which provides access to the interior of the container through the side opening when the container is in the expanded configuration, the side closing means comprising a closable flap or door.

4. The storage device as claimed in claim 3, wherein the cover frame further comprises:

a guide portion which allow the side closing portion to be inserted into the cover frame for closure of the side opening of the container.

5. The storage device as claimed in claim 1, wherein the side wall of the container is provided with a side wall connection portion.

6. The storage device as claimed in claim 1, wherein the location and orientation of the at least two venting apertures located in an upper half of the one or more protrusions allows the passage of air but prevents the direct fall of dust from entering the storage device.

7. The storage device as claimed in claim 1, wherein the cover frame further comprises:

side connectors for securing the cover frame to a cover frame of an adjacent storage device.

8. The storage device as claimed in claim 7, wherein the connectors are tongue and groove connectors.

9. The storage device as claimed in claim 1, wherein the planar section of the container further comprises:

connection holes for receiving protrusions extending from a cover frame of another storage device to facilitate secure stacking.

10. The storage device as claimed in claim 1, wherein the planar section of the container mounts ground engaging feet or ground engaging casters.

11. The storage device as claimed in claim 1, wherein the storage device is made from one or more of sheet material, corrugated material, extruded moulded plastics, vacuum, roto or blow molded plastics, transparent material, cardboard and hybrid materials.

12. The storage device as claimed in claim 1, wherein the storage device further comprises:

a tray or drawer for inserting on the planar section of the storage device to form an aeration chamber.

13. A storage device comprising:

a container having a planar section and a side wall pivotably joined to the planar section so that the container is movable between a collapsed configuration in which the container is substantially flat, and an expanded configuration defining an opening to an interior of the container;

a cover frame;

a locking member for securing the cover frame to the side wall so as to close the opening of the container, whereby the locking member comprises a locking portion formed on one of the cover frame and the side wall, and a locking indent formed on one of the other of the cover frame and the side wall, the locking portion adapted for secure engagement in the locking indent, wherein the side wall further defines a side opening to the interior of the container when the container is in the expanded configuration and the container further comprises a side wall stabilizing portion provided adjacent to the side opening to the interior of the container, and wherein one or more of the planar section, side wall or the cover frame comprises an array of protrusions, wherein one or more protrusions provided on the side wall include at least two venting apertures.

* * * * *